United States Patent [19]

Parris et al.

[11] Patent Number: 4,980,127

[45] Date of Patent: Dec. 25, 1990

[54] OXIDATION RESISTANT TITANIUM-BASE ALLOY

[75] Inventors: Warren M. Parris, Las Vegas; Paul J. Bania, Boulder City, both of Nev.

[73] Assignee: Titanium Metals Corporation of America (TIMET), Pittsburgh, Pa.

[21] Appl. No.: 345,572

[22] Filed: May 1, 1989

[51] Int. Cl.[5] ..... C22C 14/00

[52] U.S. Cl. ..... 420/418; 420/421

[58] Field of Search ..... 420/418, 421

[56] References Cited

FOREIGN PATENT DOCUMENTS 796781 6/1958 United Kingdom ..... 420/418

1123592 8/1968 United Kingdom ..... 420/418

OTHER PUBLICATIONS

*Chem. Abstracts* 79(12): 69457c; "Titanium Alloys Alloyed with Refractory Elements", 1973; O. P. Solonina et al.

*Alloys of Niobium;* Prokoshkin, D. A. et al; 1965, pp. 178–181.

*Primary Examiner*—Stephen J. Lechert, Jr.

*Attorney, Agent, or Firm*—Finnegan, Henderson, Farabow, Garrett & Dunner

[57] ABSTRACT

A titanium-base alloy characterized by a combination of good oxidation resistance at temperatures of at least 1500° F. and good cold rollability. The alloy consists essentially of, in weight percent, molybdenum 14 to 20, niobium 1.5 to 5.5, silicon 0.15 to 0.55, aluminum up to 3.5, oxygen up to 0.25 and balance titanium. Preferably, molybdenum is 14 to 16, niobium is 2.5 to 3.5, silicon is 0.15 to 0.25, aluminum is 2.5 to 3.5 and oxygen is 0.12 to 0.16. The alloy may be in the form of a cold reduced sheet or foil product having a thickness of less than 0.1 inch. This product may be produced by cold rolling to effect a reduction within the range of 10 to 80%.

3 Claims, No Drawings

OXIDATION RESISTANT TITANIUM-BASE ALLOY

BACKGROUND OF THE INVENTION

1. Field of the Invention

This invention relates to a titanium-base alloy characterized by a combination of good oxidation resistance and good cold formability, as well as a cold reduced foil product thereof and a method for producing the same.

2. Description of the Prior Art

There is a need for a titanium-base alloy having improved oxidation resistance at temperatures up to at least 1500° F. and which may be cold-rolled to foil thicknesses by conventional practice. A product having these properties, particularly in the form of a foil, finds application in the production of metal matrix composites of the titanium-base alloy product such as those strengthened with ceramic fibers. Foil products of this type are particularly advantageous in materials used in the manufacture of aircraft intended to fly at supersonic speeds.

Since the alloy finds particular use in foil applications, it is necessary that it be amenable to conversion to foil gages using conventional equipment and procedures for the manufacture of continuous strip, such as hot and cold rolling equipment. This in turn requires a beta type alloy, which may be stable or metastable, because commercially available methods and equipment for producing continuous strip of other types of titanium-base alloys, such as alpha-beta and alpha types, are not commercially available. The oxidation resistant properties of the alloy are significant for supersonic aircraft manufacture, because the alloy is subjected to extremely high temperatures during supersonic flight. It is necessary that the alloy be resistant to oxidation under these temperature conditions.

At present, there is not an alloy that has a combination of oxidation resistance at elevated temperature with cold rollability sufficient to enable the production of foil by conventional methods.

SUMMARY OF THE INVENTION

It is accordingly a primary object of the present invention to provide a titanium-base alloy having a combination of good oxidation resistance at temperatures of at least 1500° F. and good cold rollability permitting processing to sheet or foil by continuous cold-rolling practices.

It is an additional object of the invention to provide a foil product having the aforementioned properties and a method for producing the same.

In accordance with the invention there is provided a titanium-base alloy characterized by a combination of good oxidation resistance at temperatures of at least 1500° F. and good cold formability and cold rollability to permit at least about an 80% reduction by cold reduction practices. The alloy consists essentially of, in weight percent, molybdenum 14 to 20, niobium 1.5 to 5.5, silicon 0.15 to 0.55, aluminum up to 3.5, oxygen up to 0.25 and balance titanium and incidental impurities. A preferred composition in accordance with the invention is molybdenum 14 to 16, niobium 2.5 to 3.5, silicon 0.15 to 0.25, aluminum 2.5 to 3.5, oxygen 0.12 to 0.16 and balance titanium and incidental impurities.

The alloy of the invention has good oxidation resistance as exhibited by a weight gain of about 0.1 times that of commerically pure titanium under similar time at temperature conditions.

The alloy may be in the form of a cold reduced sheet or foil product having a thickness of less than 0.1 in.

In accordance with the method of the invention the flat rolled product, which may include sheet or foil, may be produced by cold rolling a hot rolled coil or sheet of the alloy to effect a cold reduction within the range of 10 to 80% to produce the sheet or foil product having a thickness of less than 0.1 in.

DETAILED DESCRIPTION OF THE PREFERRED EMBODIMENTS

In the experimental work leading to and demonstrating the invention, experimental alloys were produced and tested using an alloy of, in weight percent, 15 molybdenum, balance titanium as a base alloy. To this base alloy various beta stabilizing elements were added, either singly or in combination, in amounts of up to 5% by weight. The neutral elements, namely tin and zirconium, as well as the alpha stabilizer element aluminum, were also evaluated with respect to the base composition.

Individual alloys were melted as 250-gm button melts. These were converted to sheet by hot rolling to 0.100 in thickness, conditioned and cold rolled by a 40% reduction to a thickness of 0.060 in. The cold rolling step was used as a preliminary indicator of the suitability of the various alloys for continuous strip processing and thus any alloys which cracked during cold rolling were not further considered in the evaluations. The oxidation resistance of alloys in accordance with the invention at temperatures of 1200° and 1500° F. were compared to conventional Grade 2 titanium and to conventional titanium-base alloys.

TABLE 1

Results of Oxidation Tests on Various Titanium Alloys[1]

| Alloy | Test Temp. F | Weight Gain mg/cm$^2$ 24 Hrs | 48 Hrs | 72 Hrs | 96 Hrs |
|---|---|---|---|---|---|
| Ti-50A | 1200 | 0.50 | 0.72 | 1.00 | 1.11 |
| (Grade 2) | 1500 | 7.30 | 14.35 | 20.64 | 26.10 |
| Ti-15V-3Cr-3Sn-3Al | 1200 | 3.39 | 4.79 | 6.15 | 8.24 |
| | 1500 | 102.6 | 172.3 | 2 | 2 |
| Ti-14Al-2l/Nb | 1200 | 0.08 | 0.07 | 0.08 | 0.10 |
| (Alpha 2 Aluminide) | 1500 | 0.41 | 0.52 | 0.61 | 0.73 |
| Ti-15Mo-2.5Nb-0.2Si | 1200 | 0.14 | 0.23 | 0.27 | 0.32 |
| -3Al | 1500 | 1.21 | 1.75 | 2.06 | 2.88 |

[1]Coupons exposed at temperature shown in circulating air.
[2]0.050" sheet sample was completely converted to oxide.

As may be seen from the oxidation test results presented in Table 1, the alloy in accordance with the invention exhibited much greater oxidation resistance than the conventional materials, particularly at the test temperature of 1500° F. The oxidation resistance of the alloy in accordance with the invention was somewhat lower than that of the Ti-14Al-21Nb alloy; however, this alloy is very difficult and costly to produce in thin sheet or foil.

The alloy in accordance with the invention is highly formable, as shown by the bend test data presented in Table 2.

TABLE 2

Bend Ductility of the Ti-15Mo-3Nb-0.2Si-3Al Alloy At Two Oxygen Levels[1]

| Oxygen, % | Bend Radius, T Pass | Fail |
|---|---|---|
| 0.14 | 0.94 | 0.76 |

TABLE 2-continued

| Bend Ductility of the Ti-15Mo-3Nb-0.2Si-3Al Alloy At Two Oxygen Levels[1] | | |
|---|---|---|
| | Bend Radius, T | |
| Oxygen, % | Pass | Fail |
| 0.25 | 0.56 | 0.40 |

[1]0.050" Gage Sheet
Annealed
0.14% $O_2$ - 1500 F
0.25% $O_2$ - 1575 F

The alloy of the invention may be heat treated to high strength levels and also retain adequate ductility, as shown in Table 3.

TABLE 3

| Room Temperature Tensile Properties of the Ti-15Mo-3Nb-0.2Si-3Al Alloy After Various Heat Treatments[1] | | | | | | |
|---|---|---|---|---|---|---|
| Heat | Annealing[2] | Aging | | UTS, | YS | |
| No. | Temp, F. | Temp, F. | Time, Hrs | ksi | ksi | Elong, % |
| V-6966[3] | 1575 | None | | 135.1 | 132.6 | 15 |
| | 1575 | 900 | 8 | 177.7 | 161.7 | 5 |
| | 1575 | 900 | 24 | 221.8 | 211.0 | 3 |
| | 1575 | 1000 | 8 | 201.4 | 189.8 | 3 |
| | 1575 | 1000 | 24 | 201.5 | 193.9 | 3.5 |
| | 1575 | 1100 | 8 | 170.0 | 160.1 | 7.5 |
| | 1575 | 1100 | 24 | 174.0 | 163.7 | 6.5 |
| V-7074[4] | 1500 | None | | 127.7 | 124.8 | 12 |
| | 1500 | 900 | 8 | 182.3 | 166.0 | 4 |
| | 1500 | 900 | 24 | 207.3 | 191.4 | 3.5 |
| | 1500 | 1000 | 8 | 184.1 | 171.9 | 5 |
| | 1500 | 1000 | 24 | 183.9 | 172.9 | 6 |
| | 1500 | 1100 | 8 | 154.3 | 144.5 | 11 |
| | 1500 | 1100 | 24 | 161.9 | 153.6 | 8 |

[1]0.050" gage sheet
[2]Annealing time - 10 min followed by an air cool
[3]Oxygen content - 0.25%
[4]Oxygen content - 0.14%

The data of Table 3 illustrate in particular the strenghtening effects of increasing the oxygen content of the alloy in accordance with the invention.

As shown in Table 4, the invention alloy exhibits much improved corrosion resistance in the designated dilute acids compared to the two additional conventional materials subjected to the same tests.

TABLE 4

| Comparison of Corrosion Rates of the Ti-15Mo-3Nb-0.2Si-3Al and Other Titanium Alloys in Boiling Dilute Acids | | | | |
|---|---|---|---|---|
| | | Corrosion Rate, mils/yr | | |
| Acid | Concentration, % | Grade 2 Ti | TI-CODE 12 | Ti-15Mo-3Nb-0.2Si-3Al |
| HCl | 2 | 225 | 20 | 0.9 |
| | 3 | 370 | 230 | 2.2 |
| | 4 | 560 | 824 | 5.2 |
| $H_2SO_4$ | 2 | 887 | 974 | 7.1 |
| | 5 | 893 | — | 28 |

Carefully weighed coupons of sheet produced from the 250-gm button melts of the compositions listed in Table 5 were exposed to temperatures of 1500° F. (816° C.) in circulating air for times up to 48 hours. The specimens were again weighed and the percentage of weight gain was used as the criterion for determining oxidation resistance.

TABLE 5

| Results of Oxidation Tests at 1500 F. on Ti-15Mo and Ti-20Mo Base Alloys | | |
|---|---|---|
| | % Weight Gain In | |
| Nominal Composition | 24 Hours | 48 Hours |
| Ti-15Mo | 1.75 | 2.63 |

TABLE 5-continued

| Results of Oxidation Tests at 1500 F. on Ti-15Mo and Ti-20Mo Base Alloys | | |
|---|---|---|
| | % Weight Gain In | |
| Nominal Composition | 24 Hours | 48 Hours |
| Ti-15Mo-2Nb | 0.72 | 0.98 |
| Ti-15Mo-5Nb | 0.82 | 0.95 |
| Ti-15Mo-3Ta | 0.81 | 1.04 |
| Ti-15Mo-5Hf | 0.71 | 1.41 |
| Ti-5Fe | 0.9 | 2.10 |
| Ti-5Zr | 1.32 | 7.70 |
| Ti-15Mo-0.1Si | 0.84 | 1.45 |
| Ti-15Mo-0.2Si | 0.71 | 1.27 |
| Ti-15Mo-0.5Si | 0.82 | 1.17 |
| Ti-15Mo-3Al | 0.91 | 2.00 |
| Ti-15Mo-5Nb-0.5Si | 0.51 | 0.71 |
| Ti-15Mo-5Nb-0.5Si-3Al | 0.42 | 0.60 |
| Ti-15Mo-3Nb-1.5Ta-3Al | 0.67 | 0.83 |
| Ti-15Mo-5Nb-2Hf-0.5Si-3Al | 0.33 | 0.58 |
| Ti-20Mo-2Nb | 0.67 | 0.99 |
| Grade 2 CP | 4.20 | 7.70 |
| Ti-15V-3Cr-3Sn-3Al | 64.7 | ** |

**Completely Converted to Oxide

In accordance with the oxidation tests as reported in Table 5, the individual alloying elements that appeared most promising for modification of the base alloy were niobium, tantalum and silicon. Aluminum also had a relatively slight effect and is otherwise desirable for metastable beta alloys because of its inhibiting effect on the formation of an embrittling omega phase. It was also established by the results of Table 5 that the effects of the various elements on oxidation resistance could be additive. For example, the weight gain of the Ti-15Mo-5Nb-0.5Si alloy was appreciably less than that of either the Ti-15Mo-5Nb alloy or the Ti-15Mo-0.5Si alloy.

The data of Table 5 shows that increasing the molybdenum content of the base alloy above 15% has no beneficial effect on oxidation resistance and would be undesirable from the standpoint of increasing the cost of the alloy as well as the density thereof. Likewise, increasing the niobium content from 2 to 5% has little or no effect on oxidation resistance and as well would have the aforementioned undesirable effects. The Table 5 data also show that the addition of 5% zirconium to the Ti-15Mo base alloy had a pronounced deleterious effect on oxidation resistance.

In view of the evaluation of the alloys set forth in Table 5, four alloys were melted as 18-pound ingots and processed to sheet. The results of oxidation tests on these alloys at temperatures of 1200° and 1500° F. compared to Grade 2 titanium are presented in Table 6.

TABLE 6

Results of Oxidation Tests on 0.050" Sheet from 18-Lb Ingots[1]

| Nominal Composition | Test Temp F. | Weight Gain, Percent in: 24 Hrs | 48 Hrs | 72 Hrs | 96 Hrs |
|---|---|---|---|---|---|
| Ti-15Mo-5Nb-0.5Si | 1200 | 0.064 | 0.094 | 0.113 | 0.116 |
| | 1500 | 0.40 | 0.63 | 0.68 | 0.73 |
| Ti-15Mo-5Nb-0.5Si-3Al | 1200 | 0.057 | 0.074 | 0.110 | 0.121 |
| | 1500 | 0.40 | 0.59 | 0.75 | 0.90 |
| Ti-15Mo-2Nb-0.2Si-3Al | 1200 | 0.040 | 0.050 | 0.070 | 0.076 |
| | 1500 | 0.33 | 0.47 | 0.54 | 0.62 |
| Ti-15Mo-3Nb-1.5Ta-0.2Si-3Al | 1200 | 0.047 | 0.070 | 0.101 | 0.128 |
| | 1500 | 0.37 | 0.51 | 0.57 | 0.67 |
| Ti-50A | 1200 | 0.137 | 0.216 | 0.30 | 0.362 |
| | 1500 | 1.50 | 2.87 | 4.09 | 5.20 |

[1]Continuous exposure in circulating air.

Bend ductility, as a measure of sheet formability, for the four heats of Table 6 are presented in Table 7.

TABLE 7

Bend Ductility of Annealed 0.050" Sheet From the 18-Lb. Ingots

| Nominal Composition[1] | Pass[2] | Fail[2] |
|---|---|---|
| Ti-15Mo-5Nb-0.5Si | 2.1T | 1.7T |
| Ti-15Mo-5Nb-0.5Si-3Al | 1.5T | 1T |
| Ti-15Mo-2Nb-0.2Si-3Al | 0.8T | 0.6T |
| Ti-15Mo-3Nb-1.5Ta-0.2Si-3Al | 0.7T | 0.5T |

[1]Solution annealed condition
[2]T=sheet thickness; standard bend test procedure per ASTM E 290

The tensile properties after various aging treatments for the four alloys are set forth in Table 8.

TABLE 8

Tensile Properties of 0.050" Sheet From 18-Lb. Ingots

| Nominal Composition | Anneal Temp F. | Age Temp[1] | Dir. | UTS ksi | YS ksi | % Elong |
|---|---|---|---|---|---|---|
| Ti-15Mo-5Nb-0.5Si | 1550 | None | L | 138.9 | 135.2 | 12 |
| | | | T | 139.3 | 136.6 | 10 |
| | 1550 | 900 | L | 196.3 | 196.3 | 1 |
| | | | T | 201.2 | 201.2 | 0.5 |
| | 1550 | 1000 | L | 160.4 | 150.6 | 10 |
| | | | T | 164.8 | 151.2 | 8 |
| | 1550 | 1100 | L | 140.1 | 133.5 | 9.5 |
| | | | T | 140.7 | 133.4 | 9 |
| Ti-15Mo-5Nb-0.5Si-3Al | 1550 | None | L | 128.8 | 126.5 | 19 |
| | | | T | 132.9 | 128.7 | 4.5 |
| | 1550 | 900[2] | L | 167.6 | 150.0 | 9 |
| | | | T | 166.5 | 157.0 | 4 |
| | 1550 | 1000 | L | 191.2 | 172.3 | 5 |
| | | | T | Brittle Fracture | | — |
| | 1550 | 1100 | L | 156.8 | 144.5 | 11.5 |
| | | | T | 160.2 | 148.8 | 7 |
| Ti-15Mo-2Nb-0.2Si-3Al | 1500 | None | L | 129.8 | 125.5 | 18 |
| | | | T | 131.2 | 127.0 | 12 |
| | 1500 | 900[2] | L | 172.9 | 156.8 | 5.5 |
| | | | T | 178.3 | 164.0 | 3.5 |
| | 1500 | 1000 | L | 187.8 | 174.2 | 6.5 |
| | | | T | 196.4 | 182.4 | 4 |
| | 1500 | 1100 | L | 151.7 | 135.6 | 14.5 |
| | | | T | 158.1 | 147.1 | 12.0 |
| Ti-15Mo-3Nb-1.5Ta-0.2Si-3Al | 1500 | None | L | 127.0 | 122.6 | 23 |
| | | | T | 128.9 | 124.8 | 17.5 |
| | 1500 | 900[2] | L | 145.2 | 135.8 | 10 |
| | | | T | 145.3 | 136.6 | 9 |
| | 1500 | 1000 | L | 185.0 | 172.0 | 7.5 |
| | | | T | 188.5 | 173.9 | 6 |
| | 1500 | 1100 | L | 148.9 | 135.5 | 13.5 |
| | | | T | 150.6 | 138.7 | 13 |

[1]Aging time - 8 hours
[2]Incomplete aging

As may be seen from the test results reported herein the alloy of the invention exhibits a heretofore unattainable combination of cold rollability and oxidation resistance which permits processing of the alloy to product thicknesses of less than 0.1 in, including the production of foil.

The term commercially pure titanium is well known in the art of titanium metallurgy and the definition thereof is in accordance with ASTM B 265-72.

In the examples and throughout the specification and claims, all parts and percentages are by weight percent unless otherwise specified.

What is claimed is:

1. A titanium-base alloy having a combination of good oxidation resistance at temperatures of at least 1500° F. and good cold formability and cold rollability to permit at least about an 80% cold reduction, said alloy consisting essentially of, in weight percent, molybdenum 14 to 20, niobium 1.5 to 5.5, silicon 0.15 to 0.55, aluminum up to 3.5, oxygen up to 0.25 and balance titanium and incidental impurities.

2. The alloy of claim 1 wherein molybdenum is 14 to 16, niobium is 2.5 to 3.5, silicon is 0.15 to 0.25, aluminum is 2.5 to 3.5 and oxygen 0.12 to 0.16.

3. The alloy of claim 1 or claim 2 having good oxidation resistance exhibited by a weight gain of about 0.1 times that of commercially pure titanium under similar time at temperature conditions.

* * * * *